US005561927A

United States Patent [19]

Blavat

[11] Patent Number: 5,561,927

[45] Date of Patent: Oct. 8, 1996

[54] NEEDLEWORK AID DEVICE AND METHOD FOR SECURING AND WORKING WITH A NEEDLEWORK FABRIC

[76] Inventor: Betty Blavat, 3201 Malibu Vista, Las Vegas, Nev. 89117

[21] Appl. No.: 405,752

[22] Filed: Mar. 20, 1995

[51] Int. Cl.[6] ..... D06C 3/06

[52] U.S. Cl. ..... 38/102.91; 38/102.21

[58] Field of Search ..... 38/102.91, 102, 38/102.21, 69, 70; 242/600, 583, 598.3, 598.4, 538.2, 546.1, 586.4; 101/127.1; 160/238, 378, 382, 383, 385

[56] References Cited

U.S. PATENT DOCUMENTS

| | | | |
|---|---|---|---|
| 761,751 | 6/1904 | Barrett | 38/141 X |
| 2,569,337 | 9/1951 | Rice | 38/102.21 |
| 3,098,280 | 7/1963 | Harris et al. | 38/102.91 X |
| 3,217,137 | 11/1965 | Weitzner | 38/141 X |
| 3,979,844 | 9/1976 | Smith | 38/102.91 |
| 4,343,103 | 8/1982 | Murashima | 38/102 |
| 4,417,409 | 11/1983 | Bell | 38/102.91 |
| 4,860,467 | 8/1989 | Larson | 38/102.91 X |
| 5,347,732 | 9/1994 | Padawer | 160/395 X |

FOREIGN PATENT DOCUMENTS

| | | | |
|---|---|---|---|
| 0332094 | 5/1903 | France | 162/270 |

*Primary Examiner*—Ismael Izaguirre
*Attorney, Agent, or Firm*—Young & Basile, P.C.

[57] ABSTRACT

A needlework aid device is for use with a needlework fabric having an edge portion, a right side and a wrong side. The needlework aid device comprises a mechanism for rolling the fabric with one hand. The device further comprises a mechanism, attached to the right side of the fabric, for releasably mounting the fabric to the rolling mechanism. A method for securing and working with the needlework fabric comprises the steps of releasably mounting the fabric edge portion to an elongated tube; and rolling the fabric to expose a desired area to be needleworked, such that the wrong side of the fabric faces outwardly from the elongated tube during the rolling step, whereby the right side of the fabric is protected from soiling during rolling and needleworking.

13 Claims, 1 Drawing Sheet

NEEDLEWORK AID DEVICE AND METHOD FOR SECURING AND WORKING WITH A NEEDLEWORK FABRIC

BACKGROUND OF THE INVENTION

The present invention relates generally to needlework devices, and more particularly to such a device which aids in completing a needlework pattern quickly and efficiently, while keeping the needlework fabric clean and wrinkle-free.

Needlework art, practiced by millions of persons of all ages, continues to grow as the population increases. A basic essential of the art's application is a pattern in the form of Cartesian coordinate-arranged small symbols indicating required yarn or floss color and location of required needle insertion points. A suitable needlepointing fabric may be tautly assembled to a scroll frame, designed to allow fabric to be progressively exposed for needlepointing. The frame is usually either mounted to a free-standing holding device or maintained in the lap. The fabric may also be tautly held within a needleworking hoop. This device allows certain portions of the fabric to be exposed, depending on the area in which the needleworker is focusing.

In needlework, the person looks at the pattern to determine the required floss color and point of insertion of the floss-threaded needle through the frame or hoop-mounted fabric. The person then inserts the needle through the fabric and, as required floss changes, cuts and ties the floss on the under surface, ie. "wrong side" of the fabric. As can be expected, this portion of the art is intricate, requiring much concentration and steadiness of hand. As a consequence, the needleworker does not have available an inordinate amount of attention to pay as to where or how the non-working hand is gripping the fabric.

Some needlepointing devices have been proposed. One such device is disclosed in U.S. Pat. No. 3,979,844 issued to Smith. This device mounts the fabric between two pairs of elongated support members. The fabric is connected by tacks and the like. This device requires a substantial amount of time and attention in order to accurately secure both ends of the fabric, each end between a pair of the support members. Further, anytime the person has to unroll or roll the fabric, the person must stop working, put down the needle, remove a pair of rubber bands from one or both support members, roll the fabric to the desired spot, and replace and readjust the rubber bands on the support member(s).

Thus, it is an object of the present invention to provide a needlework aid device which is quickly and easily attached to the fabric, thus advantageously reducing to a minimum the time and effort required to perform this task. It is a further object of the present invention to provide a needlework aid device which eliminates the need for the needleworker to remove and replace the fabric within a frame or hoop, thus advantageously saving the needleworker further time and effort, while at the same time preventing the fabric from becoming wrinkled. Yet further, it is an object of the present invention to provide such a needlework aid device which will aid in preventing the fabric from becoming soiled. It is a further object of the present invention to provide such a device which is simple in design, easy and inexpensive to manufacture and sell, and lightweight and non-bulky for easy portability. It is yet a further object of the present invention to provide such a device which advantageously aids in prevention of fabric edge unraveling. Yet still further, it is an object of the present invention to provide such a needlework aid device which reduces fatigue from present needlework art, while at the same time increasing its pleasure.

SUMMARY OF THE INVENTION

The present invention addresses and solves the problems enumerated above. The present invention comprises a needlework aid device for use with a needlework fabric. The fabric has an edge portion, a right side and a wrong side. The needlework aid device comprises means for rolling the fabric with one hand. The device further comprises means, attached to the right side of the fabric, for releasably mounting the fabric to the rolling means.

The present invention further comprises a method for securing and working with the needlework fabric. The method comprises the steps of releasably mounting the fabric edge portion to an elongated tube; and rolling the fabric to expose a desired area to be needleworked, such that the wrong side of the fabric faces outwardly from the elongated tube during the rolling step, whereby the right side of the fabric is protected from soiling during rolling and needleworking.

BRIEF DESCRIPTION OF THE DRAWINGS

Other objects, features and advantages of the present invention will become apparent by reference to the following detailed description and drawings, in which.

DETAILED DESCRIPTION OF THE PREFERRED EMBODIMENTS

Figure 1:
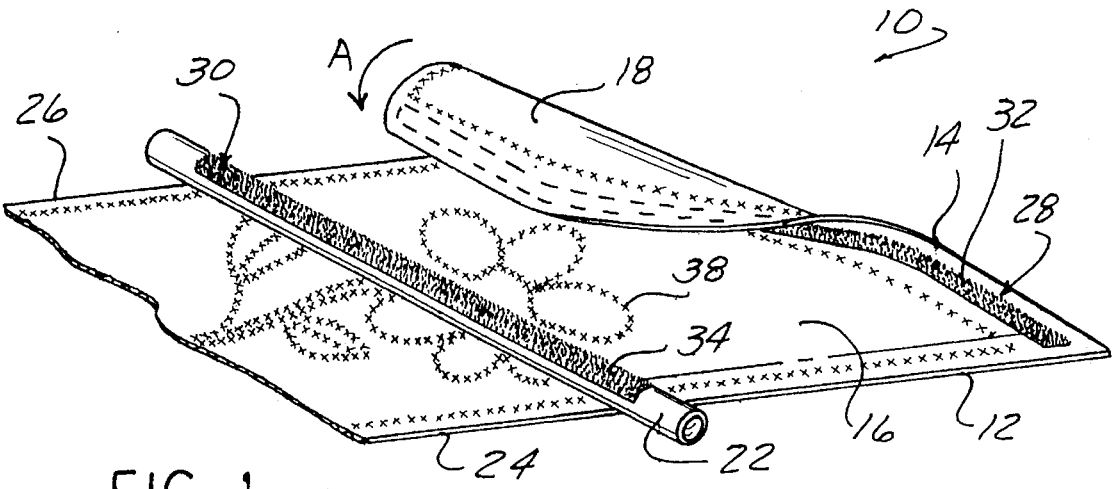
FIG. 1 is a partially cut away, perspective view of the needlework aid device of the present invention, showing the elongated tube detached from the needlework fabric, with one corner of the fabric turned over to show the direction of fabric roll, as well as the wrong side of the fabric.

Referring now to FIG. 1, the needlework aid device of the present invention is designated generally as 10. It is to be understood that the term "needlework" as used herein includes, but is not limited to needlepointing, cross-stitching, embroidering, sewing, and the like. The needlework aid device 10 is for use with a needlework fabric 12. The fabric 12 has an edge portion 14, a right side 16 and a wrong side 18.

Figure 2:
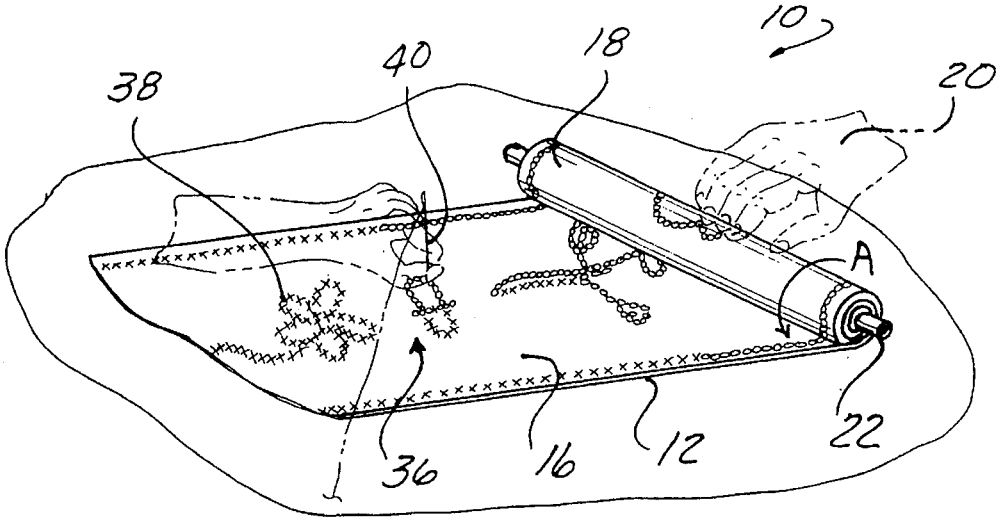
FIG. 2 is a partially cut away, perspective view showing the present invention in use, with both the needleworker's hands shown in phantom.

The needlework aid device comprises means for rolling the fabric 12 with one hand 20, as best seen in FIG. 2. It is to be understood that this one-handed fabric rolling means may comprise any suitable means. However, in the preferred embodiment, this one-handed fabric rolling means comprises an elongated tube 22. This tube 22 may be of any length as desired, and of any diameter. This would depend upon the length and/or width of the fabric 12 used. Further, the tube 22 may extend beyond the fabric 12 (as shown in FIGS. 1 and 2), or it may be substantially even with the fabric edges 24, 26. It is preferred that the tube 22 not be substantially shorter than the length and/or width of the fabric 12. In the preferred embodiment, the outer diameter of tube 22 is about ¾ inch, (1.9 cm) and the length is between about 15 (38.1 cm) and about 30 inches (76.2 cm).

It is to be further understood that tube 22 may be of any shape desired, such as circular, triangular, square, etc., and dependant upon the particular application of the device 10. In the preferred embodiment, the elongated tube 22 is cylindrically shaped. Tube 22 may further be formed from any suitable material, such as wood, metal, glass, etc. In the preferred embodiment, tube 22 is formed from a rigid polymeric material. Also, tube 22 may be hollow, as shown in FIG. 1, in order to render the device 10 more lightweight and easily portable, as well as cutting down on material costs.

Needlework aid device further comprises means, preferably attached to the right side 16 of the fabric edge portion 14, for releasably mounting the fabric 12 to the rolling means. It is to be understood that the edge portion 14 may be in the location shown in the Figures, or it may be interchanged with edges 24, 26, etc. This releasable fabric mounting means may comprise any suitable means, such as non-permanent adhesive, tacks, and the like, but in the preferred embodiment, this means comprises a first 28 and a second 30 matingly engageable coupling member, the first coupling member 28 being disposed on one of the fabric 12 and the one-handed fabric rolling means, and the second coupling member 30 being disposed on the other of the fabric 12 and the one handed fabric rolling means. Although these are interchangeable as just stated, for illustrative purposes in FIG. 1, first coupling member 28 is shown on fabric 12, and second coupling member 30 is shown on tube 22. It is to be further understood that these coupling members 28, 30 may comprise any suitable means, however, in the preferred embodiment, first coupling member 28 comprises hooks 32 and second coupling member 30 comprises loops 34. One such mating hook 32 and loop 34 fastener is commercially available under the trademark VELCRO. Further, although the coupling members 28, 30 are shown covering substantial portions of tube 22 and fabric edge portion 14, it is to be understood that any suitable amount and positioning may be used, as desired and/or necessary. This is true also for other suitable releasable mounting means which may be used.

The releasable fabric mounting means may be permanently or releasably attached to fabric edge portion 14. If it is permanently attached, after the fabric 12 is fully needleworked, the needleworker may wish to cut off this portion of the fabric 12 prior to finishing and/or framing. If it is releasably attached, the needleworker may wish to remove the mounting means from this portion of the fabric 12 prior to finishing and/or framing.

According to the present invention, a method for securing and working with the needlework fabric 12 comprises the step of releasably mounting the fabric edge portion 14 to elongated tube 22. As described above, the tube 22 may be of any suitable size, shape and material. The releasable mounting may be accomplished by any of the means set forth above, as well as by other suitable means, however, in the preferred embodiment, this fabric edge mounting step comprises the steps of adhesively securing a mating hook fastener 32 to one of the fabric edge portion 14 and the elongated tube 22; and adhesively securing a mating loop fastener 34 to the other of the fabric edge portion 14 and the elongated tube 22.

Figure 3:
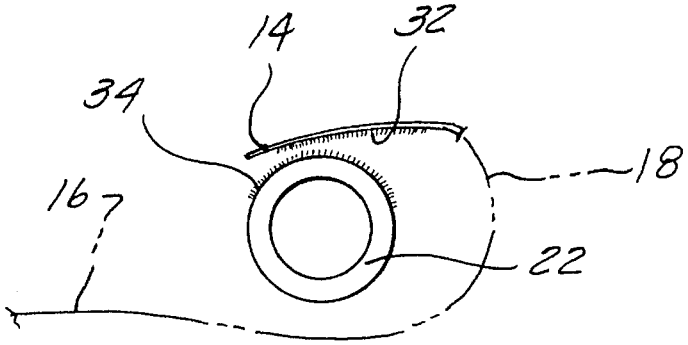
FIG. 3 is an enlarged, somewhat schematic side view of the present invention, showing the fabric partially rolled around the elongated tube.

As best seen in FIG. 2, the method further comprises the step of rolling the fabric 12 to expose a desired area 36 to be needleworked, such that the wrong side 18 of the fabric faces outwardly from the elongated tube 22 during the rolling step, whereby the right side 16 of the fabric is protected from soiling during rolling and needleworking. This outward/inward orientation is best shown in FIG. 3. In all three Figures, the direction of roll is designated by arrow A.

Either the right side 16 or the wrong side 18 of edge portion 14 may be attached to tube 22; however, if the wrong side 18 is attached, the needleworker should still roll the fabric 12 around tube 22 such that the wrong side 18 faces outwardly from tube 22, as described above.

After the fabric has been needleworked with as many patterns 38 as desired, the method may further comprise the step of detaching the right side fabric edge portion 14 of the unrolled fabric 12 from the elongated tube 22. If the mounting means is permanently attached to the fabric edge portion 14, or if the needleworker so desires, the method may yet further comprise the step of cutting off the fabric edge portion 14 including the one of the mating hook fastener 32 and the mating loop fastener 34, or including whichever mounting means was chosen, prior to finishing and/or framing. If the mounting means is not permanently attached to the fabric edge portion 14, the method may yet further comprise the step of removing the one of the mating hook fastener 32 and the mating loop fastener 34 from the fabric edge portion 14, prior to finishing and/or framing.

Some of the many advantages of the present invention are the following. In use, the tube 22 remains on top of the fabric 12, keeping it substantially flat. As the needleworker progresses, he/she rolls fabric 12 with one hand 20 (without having to put down the needle 40 to accomplish this, and without having to expend much time and attention) toward himself/herself from the wrong side 18, thus preventing soiling of the material by oils in the skin, as well as protecting, in the interior of the roll, the right side 16 of fabric 12 from dust and debris. This keeps the fabric 12 and needleworked patterns 38 substantially clean and wrinkle-free. Further, since mounting fabric 12 to tube 22 keeps the tube adjacent portions of edges 24, 26 taut, and since the needleworker does not need to continually take the fabric 12 in and out of needleworking hoops, the edges of the fabric will not tend to unravel. Traditionally, needleworkers have tried such means as masking tape on the edges 24, 26 of the fabric 12 to prevent this problem. However, masking tape generally will not stay on the fabric 12, and as it falls off, may actually make the unraveling problem worse. Further, the present invention is simple in design, easy and inexpensive to manufacture and sell, and lightweight and non-bulky for needleworking and for easy portability.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A needlework aid device for use with a needlework fabric, the fabric having an edge portion, a right side and a wrong side, the needlework aid device comprising:

means for rolling the fabric with one hand; and means, attached to the right side of the fabric edge portion, for releasably mounting the fabric to the rolling means, wherein the releasable fabric mounting means comprises a first and a second matingly engageable coupling member, the first coupling member being disposed on one of the fabric and the one-handed fabric rolling means, and the second coupling member being disposed on the other of the fabric and the one-handed fabric rolling means.

2. The needlework aid device as defined in claim 1 wherein the one-handed fabric rolling means comprises an elongated tube.

3. The needlework aid device as defined in claim 2 wherein the elongated tube is cylindrically shaped.

4. The needlework aid device as defined in claim 3 wherein the elongated tube is hollow and is formed from a rigid polymeric material.

5. The needlework aid device as defined in claim 1 wherein the first coupling member comprises hooks and the second coupling member comprises loops.

6. The needlework aid device as defined in claim 1 wherein the releasable fabric mounting means is releasably attached to the right side of the fabric.

7. A needlework aid device for use with a needlework fabric, the fabric having an edge portion, a right side and a wrong side, the needlework aid device comprising:

means for rolling the fabric with one hand, wherein the one-handed fabric rolling means comprises a cylindrically shaped elongated tube; and means, attached to the right side of the fabric edge portion, for releasably mounting the fabric to the rolling means, wherein the releasable fabric mounting means comprises a first and a second matingly engageable coupling member, the first coupling member being disposed on one of the fabric and the elongated tube, and the second coupling member being disposed on the other of the fabric and the elongated tube, and wherein the first coupling member comprises hooks and the second coupling member comprises loops.

8. The needlework aid device as defined in claim 7 wherein the elongated tube is hollow and is formed from a rigid polymeric material.

9. A method for securing and working with a needlework fabric, the fabric having an edge portion, a right side and a wrong side, the method comprising the steps of:

releasably mounting the right side of the fabric edge portion to an elongated tube, wherein the fabric edge mounting step comprises the steps of:

adhesively securing a mating hook fastener to one of the right side fabric edge portion and the elongated tube; and adhesively securing a mating loop fastener to the other of the right side fabric edge portion and the elongated tube; and rolling the fabric to expose a desired area to be needleworked, such that the wrong side of the fabric faces outwardly from the elongated tube during the rolling step, whereby the right side of the fabric is protected from soiling during rolling and needleworking.

10. The method as defined in claim 9 wherein the elongated tube is hollow, cylindrically shaped and formed from a rigid polymeric material.

11. The method as defined in claim 10 wherein, after the fabric has been needleworked as much as desired, the method further comprises the step of:

detaching the right side fabric edge portion of the unrolled fabric from the elongated tube.

12. The method as defined in claim 11, further comprising the step of removing the one of the mating hook fastener and the mating loop fastener from the right side fabric edge portion.

13. The method as defined in claim 11, further comprising the step of cutting off the fabric edge portion including the one of the mating hook fastener and the mating loop fastener.

* * * * *